US009708698B2

(12) United States Patent
Choi et al.

(10) Patent No.: US 9,708,698 B2
(45) Date of Patent: Jul. 18, 2017

(54) WEAR RESISTANT STEEL HAVING EXCELLENT TOUGHNESS AND WELDABILITY

(71) Applicant: POSCO, Pohang-si, Gyeongsangbuk-do (KR)

(72) Inventors: Jong-Kyo Choi, Pohang-si (KR); Woo-Kil Jang, Pohang-si (KR); Young-Hwan Park, Pohang-si (KR); Hong-Ju Lee, Pohang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 227 days.

(21) Appl. No.: 14/369,532

(22) PCT Filed: Dec. 27, 2012

(86) PCT No.: PCT/KR2012/011559

§ 371 (c)(1),
(2) Date: Jun. 27, 2014

(87) PCT Pub. No.: WO2013/100625

PCT Pub. Date: Jul. 4, 2013

(65) Prior Publication Data

US 2014/0334967 A1 Nov. 13, 2014

(30) Foreign Application Priority Data

Dec. 28, 2011 (KR) ..... 10-2011-0145204

(51) Int. Cl.
*C22C 38/54* (2006.01)
*C22C 38/04* (2006.01)
(Continued)

(52) U.S. Cl.
CPC ..... *C22C 38/54* (2013.01); *C21D 6/005* (2013.01); *C21D 8/0226* (2013.01); *C22C 38/02* (2013.01);
(Continued)

(58) Field of Classification Search
CPC ... C21D 2211/008; C21D 6/005; C22C 38/02; C22C 36/54
(Continued)

(56) References Cited

U.S. PATENT DOCUMENTS 5,798,004 A 8/1998 Tamehiro et al.
2009/0252641 A1* 10/2009 Hoshi ..... C22C 38/12 420/118
2013/0071687 A1 3/2013 Takagi et al.

FOREIGN PATENT DOCUMENTS

CN 101151391 3/2008
CN 101676425 3/2010
(Continued)

OTHER PUBLICATIONS

English-language International Search Report from the Korean Patent Office for International Application No. PCT/KR2012/011559, mailing date Apr. 8, 2013.
(Continued)

*Primary Examiner* — Weiping Zhu
(74) *Attorney, Agent, or Firm* — Finnegan, Henderson, Farabow, Garrett & Dunner, LLP

(57) ABSTRACT

Provided is a wear resistant steel including 2.6 wt % to 4.5 wt % of manganese (Mn), carbon (C) satisfying (6-Mn)/50≤C≤(10-Mn)/50, 0.05 wt % to 1.0 wt % of silicon (Si), and iron (Fe) as well as other unavoidable impurities as a remainder, wherein a Brinell hardness of a surface portion is in a range of 360 to 440. The wear resistant steel further includes at least one component selected from the group
(Continued)

consisting of 0.1 wt % or less (excluding 0 wt %) of niobium (Nb), 0.1 wt % or less (excluding 0 wt %) of vanadium (V), 0.1 wt % or less (excluding 0 wt %) of titanium (Ti), and 0.02 wt % or less (excluding 0 wt %) of boron (B) to complement the performance thereof. The wear resistant steel is characterized in that a microstructure includes martensite in an amount of 90% or more, and an average packet diameter of the martensite is 20 μm or less.

4 Claims, 3 Drawing Sheets

(51) Int. Cl.

| | |
|---|---|
| ***C22C 38/12*** | (2006.01) |
| ***C22C 38/14*** | (2006.01) |
| ***C22C 38/02*** | (2006.01) |
| ***C21D 6/00*** | (2006.01) |
| ***C22C 38/44*** | (2006.01) |
| ***C22C 38/48*** | (2006.01) |
| ***C22C 38/50*** | (2006.01) |
| ***C21D 8/02*** | (2006.01) |

(52) U.S. Cl.
CPC ..... *C22C 38/04* (2013.01); *C22C 38/12* (2013.01); *C22C 38/14* (2013.01); *C22C 38/44* (2013.01); *C22C 38/48* (2013.01); *C22C 38/50* (2013.01); *C21D 2211/008* (2013.01)

(58) Field of Classification Search
USPC ..... 420/106
See application file for complete search history.

(56) References Cited

FOREIGN PATENT DOCUMENTS

| | | |
|---|---|---|
| EP | 1 870 483 | 12/2007 |
| EP | 2 192 205 | 6/2010 |
| JP | 50-140316 | 11/1975 |
| JP | 51-6812 | 1/1976 |
| JP | 59-143027 | 8/1984 |
| JP | 7-97657 | 4/1995 |
| JP | 7-316737 | 12/1995 |
| JP | H08209290 | 8/1996 |
| JP | 9-170046 | 6/1997 |
| JP | 10-8186 | 1/1998 |
| JP | 10-237589 | 9/1998 |
| JP | 2001-234242 | 8/2001 |
| JP | 2005-179783 | 7/2005 |
| JP | 2010-65307 | 3/2010 |
| JP | 2010-138421 | 6/2010 |
| KR | 10-2007-0099693 | 10/2007 |
| KR | 10-0797364 | 1/2008 |
| KR | 10-2009-0068989 | 6/2009 |
| WO | WO 2011-152017 | 12/2011 |

OTHER PUBLICATIONS

First Office Action issued Nov. 4, 2015, from the State Intellectual Property Office of the People's Republic of China in counterpart Chinese Patent Application No. 2012800707420.
Notice of Office Action with English language translation issued by the Japanese Patent Office on May 26, 2015, in counterpart Japanese Application No. 2014-550007.
EN ISO 18265:2003 (D) Feb. 2003, pp. 16-17.
English-language Extended European Search Report in counterpart EP 12 86 3578, mailed Mar. 3, 2016.

* cited by examiner

WEAR RESISTANT STEEL HAVING EXCELLENT TOUGHNESS AND WELDABILITY

CROSS-REFERENCE TO RELATED APPLICATIONS

This application is a national phase application of International Application No. PCT/KR2012/011559, filed Dec. 27, 2012, and claims the priority of Korean Patent Application No. 10-2011-0145204, filed Dec. 28, 2011, the content of both of which is incorporated herein by reference.

TECHNICAL FIELD

The present invention relates to a steel used in heavy construction equipment, dump trucks, machinery for mining, and conveyors, having a Brinell hardness of 360 or more, and more particularly, to a wear resistant steel having excellent toughness and weldability.

BACKGROUND ART

Wear resistant steels are currently used in equipment or parts used in industrial sectors such as construction, transportation, mining, and railway engineering requiring wear resistant characteristics.

Wear resistant steels are broadly categorized as austenitic work hardened steels and high hardness martensitic steels.

A representative example of an austenitic work hardened steel is a Hadfield steel which has been used for about 100 years. Hadfield steel includes about 12% of manganese (Mn) and about 1% of carbon (C), wherein the microstructure thereof includes austenite, and Hadfield steel is in use in various sectors such as the mining industry, in railway engineering, and in the defense sector. However, since the initial yield strength thereof is relatively low at about 400 MPa, the use thereof as a general wear resistant steel or structural steel is limited.

In contrast, since high hardness martensitic steels have high yield strength and tensile strength, the high hardness martensitic steels are being widely used in structural materials and transportation/construction equipment. In general, a high hardness steel includes high amounts of carbon and high amounts of alloying elements, and a quenching process is essential for securing a martensitic structure capable of providing sufficient strength. Typical martensitic wear resistant steels include HARDOX series steels by SSAB AB, in which both strength and hardness are excellent.

There are many cases in which wear resistant steels having high resistance to abrasive wear are required according to the use environment thereof, and the hardness of a surface portion of such steels is very important to secure resistance to abrasive wear therein. Typically, large amounts of alloying elements are added to obtain high hardness of the surface portion, and the wear resistant steels for abrasive wear resistance contain a large amount of carbon having a large effect on the hardness of the surface portion. However, when the large amount of carbon is contained, cracks may easily occur in welding zone during welding. Also, when the thickness of a product increases, it may be difficult to obtain high hardness in to the center thereof. Thus, a large amount of a hardening element, such as chromium (Cr) or molybdenum (Mo), is added to compensate for this. However, since an expensive hardening element must be added, manufacturing costs may increase. In addition, relatively expensive nickel (Ni) may also be added to improve impact characteristics of a product. However, the required amount of Ni increases when the thickness of the product increases. Thus, it may be uneconomical.

DISCLOSURE

Technical Problem

An aspect of the present invention provides a low cost, wear resistant steel for abrasive wear resistance, in which amounts of alloying components, such as nickel (Ni), molybdenum (Mo), and chromium (Cr), relatively expensive elements increasing manufacturing costs, are relatively reduced and properties of a welding zone are also excellent.

Technical Solution

According to an aspect of the present invention, there is provided a wear resistant steel including: 26 wt % to 4.5 wt % of manganese (Mn); carbon (C) satisfying $(6\text{-Mn})/50 \leq C \leq (10\text{-Mn})/50$; 0.05 wt % to 1.0 wt % of silicon (Si); and iron (FE) as well as other unavoidable impurities as a remainder, wherein a Brinell hardness of a surface portion is in a range of 360 to 440.

Advantageous Effects

According to the present invention, a wear resistant steel having excellent wear resistance, weldability, and toughness may be provided.

BEST MODE

Figure 1:
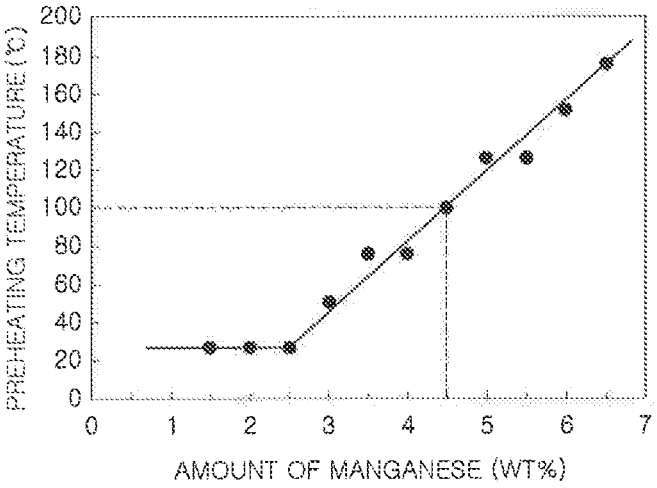
FIG. 1 illustrates the results of measuring a minimum preheating temperature for preventing the occurrence of cold cracks during a Y-groove test according to an amount of manganese.

As a result of a significant amount of research conducted to address limitations of typical wear resistant steels for abrasive wear resistance, the present inventors recognized that a wear resistant steel for abrasive wear resistance having improved wear resistance, toughness, and weldability may be manufactured by adding an appropriate amount of manganese to steel and precisely controlling an amount of carbon according to the amount of manganese while relatively reducing amounts of expensive alloying elements such as nickel, molybdenum, and chromium, thereby leading to completion of the present invention.

Thus, the present invention relates to a low carbon, high manganese wear resistant steel in which wear resistance, weldability, and toughness are improved by controlling a component system to include martensite as a main phase.

A high manganese steel generally denotes a steel having 2.6 wt % or more of manganese. A combination of various physical properties may be configured by using microstructural characteristics of the high manganese steel, and the high manganese steel has advantages that may address technical limitations of the above-described typical high carbon, high alloy martensitic wear resistant steel.

In the case that the amount of manganese is 2.6 wt % or more in a high manganese steel, since a bainite or ferrite formation curve rapidly moves backwards on a continuous cooling transformation diagram, martensite may be stably formed at a lower cooling rate than a typical high carbon wear resistant steel after hot rolling or solution treatment. Also, in the case in which the amount of manganese is high, high hardness may be obtained with a relatively lower amount of carbon than that of a typical high carbon martensitic steel.

When a wear resistant steel is manufactured using phase transformation characteristics of the high manganese steel, the deviation of hardness distribution from the surface portion to the inside may be low. A steel is rapidly cooled by water cooling to obtain martensite, and in this case, a cooling rate gradually decreases from the surface portion of the steel to the center thereof. Thus, the hardness of the center may significantly decrease as the thickness of the steel increases. In the case that a wear resistant steel is manufactured using a component system of a typical wear resistant steel, a large amount of a phase with low hardness, such as bainite or ferrite, may be formed in a microstructure of the steel when the cooling rate is low. However, in the case in which the amount of manganese is high as in the present invention, since sufficient martensite may be obtained even if the cooling rate is low, high hardness may be maintained in the center of a thick steel. This will be described in more detail according to the following examples.

The hardness rapidly increases according to the addition of the relatively small amount of carbon. However, when carbon is excessively added, impact toughness may significantly decrease. Therefore, in order for the high manganese steel to have required physical properties of a high hardness type wear resistant steel, the amount of carbon as well as manganese must be optimised. Also, alloying elements, such as niobium, vanadium, titanium, and boron, may be further added, and a steel having improved hardness, weldability, and toughness may be realized by controlling the amounts of the alloying elements.

Hereinafter, the present invention will be described in detail.

A wear resistant steel according to the present invention includes 2.6 wt % to 4.5 wt % of manganese (Mn), carbon (c) satisfying (6-Mn) /50≤C≤(10-Mn)/50, 0.05 wt % to 1.0 wt % of silicon (Si), and iron (Fe) as well as other unavoidable impurities as a remainder, wherein a brinell hardness of a surface portion is in a range of 360 HB to 440 HB.

Hereinafter, the reason for limiting components as described above in the wear resistant steel of the present invention will be described in detail.

In this case, all amounts of constituent elements denote weight percentages (wt %).

Manganese (Mn): 2.6% to 4.5%

Mn is one of most important elements that are added in the present invention. Manganese within an appropriate range may stabilize martensite. Manganese may be included in an amount of 2.6% or more to stabilize martensite within a range of carbon that will be described later. In the case that the amount of manganese is less than 2.6%, since hardenability is insufficient, ferrite or bainite may be easily formed. Thus, desired hardness of a surface portion may not be obtained. In contrast, in the case in which manganese is excessively added, welding may be difficult. In particular, in the case that the amount of manganese is greater than 4.5%, since a martensite formation temperature may excessively decrease, cracks may easily occur in a welding zone. Thus, weldability may be significantly reduced and manufacturing costs of a steel may increase. Therefore, in the present intention, a stable martensitic structure may be easily secured in a cooling stage after hot rolling or a solution treatment by including manganese in an amount ranging from 2.6% to 4.5% as described above.

In order to specifically define the upper limit of the amount of manganese at which weldability may be secured, a Y-groove test was performed in a state in which the amounts of carbon and silicon are respectively fixed to 0.1% and 0.3%, while changing the amount of manganese in a range of 1.5% to 6.5%. In this case, a thickness of a. plate was set as 20 mm, the effect of a preheating temperature on the occurrence of cold cracks was confirmed by changing the preheating temperature, and a minimum preheating temperature at which weld cracks did not occur was obtained according to the amount of manganese. The results thereof are presented in FIG. 1.

As illustrated in FIG. 1, it may be understood that manganese may be included in an amount of 4.5% or less in order to decrease the preheating temperature to 100° C. or less, i.e., a temperature that is easy to be used in an actual production process. Based on the above experimental results, there is a need to control the upper limit of the amount of manganese to be 4.5% for securing weldability.

Carbon (C): (6-Mn)/50≤C≤(10-Mn)/50

Since C exhibits similar effects to manganese in terms of facilitating the securing of hardness of a surface portion of a steel or reducing toughness or weldability, an optimum range of the amount of carbon may depend on the amount of manganese. Thus, the present patent aims at limiting a composition range in which the effect is maximized.

The amount of carbon may be added to (6-Mn)/50 or more to sufficiently secure the hardness of the surface portion that is required in the present invention. However, in the case that carbon is excessively added, since toughness and weldability are significantly reduced to cause major constraints in the usage, there is a need to control the upper limit thereof to be (10-Mn)/50 in order to obtain a Brinell hardness of the surface portion, which is limited in the present invention, ranging from 360 to 440.

Figure 2:
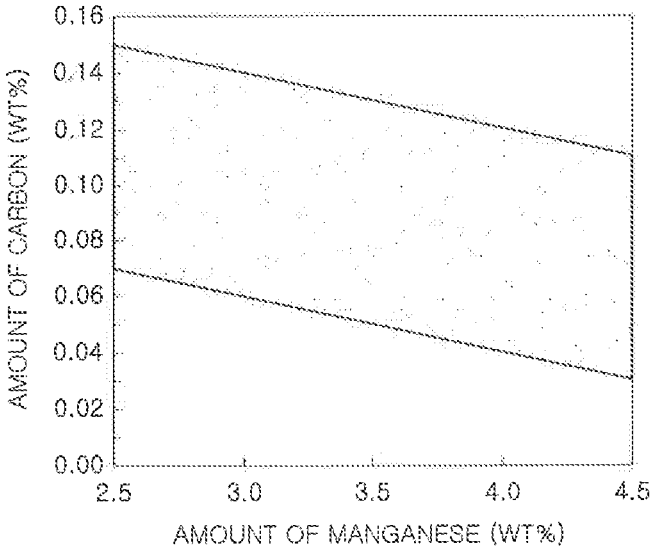
FIG. 2 illustrates ranges of the amounts of manganese and carbon which are limited in the present invention.

As described above, the present invention relates to a steel for abrasive wear resistance in which the Brinell hardness of the surface portion is limited in a range of 360 to 440. FIG. 2 illustrates ranges of the amounts of manganese and carbon which are limited in the present invention.

Figure 3:
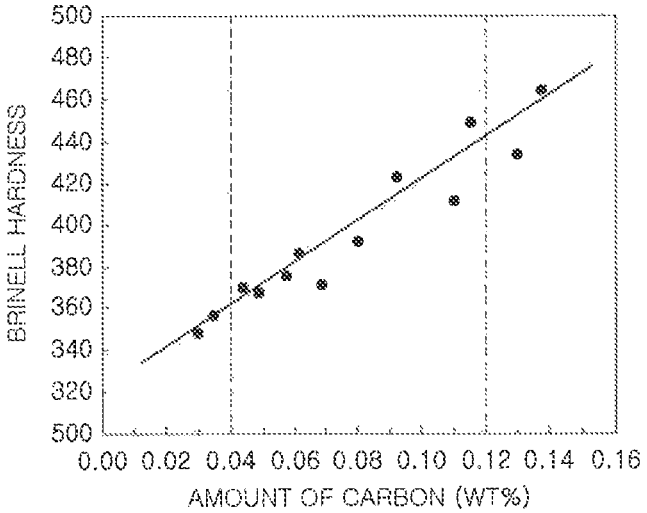
FIG. 3 illustrates changes in Brinell hardness of a surface portion according to the amount of carbon derived from the present invention.

In order to numerically limit the range of the amount of carbon according to the given amount of manganese, a martensitic structure is obtained by hot rolling and rapid cooling while fixing the amount of manganese to about 4% and changing the amount of carbon ranging from 0.03% to 0.14%, and chances in Brinell hardness of the surface portion according to changes in the amount of carbon were investigated. The results thus obtained are presented in FIG. 3. As a result, in the case that the amount of manganese included is about 4%, it may be understood that the amount of carbon must be in a range of about 0.04% to 0.12% to obtain the Brinell hardness ranging from 360 to 440. Based on the above experimental results, it may be concluded that when the amount of manganese is given, there is a need to control the amount of carbon to be in a range of (6-Mn)/50 to (10-Mn)/50 for obtaining the targeted range (360 to 440) of the Brinell hardness of the surface portion.

Silicon (Si): 0.05% to 1.0%

Si is an element that acts as a deoxidizer and improves strength by solid solution strengthening. However, the lower limit thereof is 0.05% in terms of a manufacturing process. In the case that an amount of Si is high, since Si may decrease toughness of a parent material as well as a welding zone, the upper limit of the amount of Si may be controlled to be 1.0%.

In the wear resistant steel according to the present invention, a residual component is iron (Fe). However, since unintended impurities may be inevitably introduced from raw materials surrounding environment in a typical steel manufacturing process, these impurities may not be excluded. However, since these impurities are obvious to those skilled in the art, the entire contents thereof will not be specifically described in the present specification.

In addition to the above components, the steel of the present invention may further improve the effect of the present invention when one or more elements of niobium, vanadium, titanium, and boron, which will be described below, is further added.

Niobium (Nb): 0.1% or Less (Excluding 0%)

Nb is an element that increases strength through solid solution and precipitation hardening effects, and improves impact toughness by grain refinement during cold rolling. However, in the case that niobium is added in an amount greater than 0.1%, coarse precipitates are formed to decrease hardness and impact toughness. Thus, the amount thereof may be limited to 0.1% or less.

Vanadium (V): 0.1% or Less (Excluding 0%)

V is dissolved in a steel to delay phase transformation rates of ferrite and bainite, and thus, V may have an effect of facilitating the formation of martensite. Also, vanadium increases strength through a solid solution strengthening effect. However, in the case that vanadium is added in an amount greater than 0.1%, the effect is saturated, toughness and weldability deteriorate, and manufacturing costs of the steel is significantly increased. Thus, the amount thereof may be limited to 0.1% or less.

Titanium (Ti): 0.1% or Less (Excluding 0%)

Ti maximizes the effect of boron (B) which is an important element for improving hardenability. That is, since titanium may suppress the formation of BN by forming TiN to increase an amount of dissolved H, titanium may improve hardenability. The precipitated TiN inhibits grain coarsening by pinning austenite grains. However, in the case that titanium is excessively added, toughness may decrease due to the coarsening of titanium precipitates. Thus, the amount thereof may be limited to 0.1% or less.

Boron (B): 0.02% or Less (Excluding 0%)

B is an element that effectively increases hardenability of a material even with a small addition amount, and has an effect of suppressing intergranular fractures through grain boundary strengthening. However, in the case that boron is excessively added, toughness and weldability may deteriorate due to the formation of coarse precipitates. Thus, the amount thereof may be limited to 0.02% or less.

The steel of the present invention satisfying the above-described component system may be manufactured by hot rolling and cooling process or by reheating after hot rolling and cooling process. A main phase in a microstructure of the steel thus manufactured is martensite, and the martensite may be included in an amount of 90% or more. In the case that a fraction of the martensite is less than 90%, targeted hardness of the present invention may not be obtained. Thus, it is necessary to perform rapid cooling in a state of austenite after hot rolling or reheating to obtain 90% or more of martensite. Since a cooling rate required for this may vary according to the amounts of alloying components added, it may be difficult to define unconditionally. However, in the composition range of the present invention, it may be possible to include 90% or more of martensite in the microstructure when the cooling is performed at a cooling rate of 15° C./sec or more.

In addition, an average packet diameter of the martensite, for example, may be 20 μm or less. In the case that the packet diameter is 20 μm or less, impact toughness is further improved by the refinement of martensite. Since it may be more advantageous as the diameter of the packet is smaller, the lower limit thereof not particularly limited (the concept only excludes 0 μm). However, the diameter of the packet obtained is generally 3 μm or more due to existing technical limitations. In the case that the hot rolling and cooling process are used, the lower the finish rolling temperature is, the smaller the diameter of the packet is. In the case in which the reheating and cooling process are used, the lower the reheating temperature is, the smaller the diameter of the packet is. In order to control the diameter of the packet to be 20 μm or less within the composition range of the present invention, it may be desirable to maintain the finish rolling temperature of 900° C. or less and the reheating temperature of 950° C. or less.

When a manufacturing method of hot rolling and cooling or reheating and cooling is performed on the steel having the composition range according to the present invention, it may be possible to obtain the Brinell hardness of the surface portion ranging from 360 to 440, and in addition, 25 J or more of Charpy impact energy (−40° C.) may be obtained.

Mode for Invention

EXAMPLES

Steels 1 to 18 were manufactured by a series of processes of reheating, hot rolling, and cooling with high-pressure water of slabs including alloying components listed in the following Table 1, and microstructures, diameters of martensite packets, Brinell hardness of surface portions, impact toughness, wear resistance, and weldability were then measured. The results thereof are presented in Table 2 below. Steel 19 represents an alloy composition of a Brinell hardness 400 class wear resistant steel for abrasive wear resistance manufactured by a typical method.

Steels 1 to 11 were steels that were included in the composition range limited in the present invention. However, Steel 12 was a steel in which an amount of manganese was greater than the range limited in the present invention, and Steel 13 was a steel in which the amount of manganese was less than the range limited in the present invention. Steels 14 and 15 were steels in which an amount of carbon was greater than the range limited in the present invention, and Steels 16 and 17 were steels in which the amount of carbon was less than the range limited in the present invention. Also, Steel 18 was a steel in which the amounts of carbon and manganese were respectively included in the ranges limited in the present invention, but an amount of silicon was greater than the range limited in the present invention. Microalloying elements, such as niobium, vanadium, titanium, and boron, were further included in steels 6 to 9.

Ingots having compositions of the steels listed in Table 1 were prepared in a vacuum induction furnace in the laboratory, and 70 mm thick slabs were then obtained by hot rolling the ingots. 13 mm thick plates were manufactured by rough rolling and finish rolling the slabs. The hot rolled materials were rapid cooled by being passed through an accelerated cooling device in which high-pressure water was sprayed. A finish rolling temperature was adjusted according to a test purpose, and the pressure of cooling water was adjusted to change the microstructure.

TABLE 1

| Steel | C (%) | Mn (%) | Si (%) | Ni (%) | Cr (%) | Mo (%) | Nb (%) | V (%) | Ti (%) | B (%) |
|---|---|---|---|---|---|---|---|---|---|---|
| 1 | 0.13 | 2.8 | 0.3 | — | — | — | — | — | — | — |
| 2 | 0.07 | 3.5 | 0.2 | — | — | — | — | — | — | — |
| 3 | 0.08 | 4.4 | 0.1 | — | — | — | — | — | — | — |
| 4 | 0.06 | 3.1 | 0.4 | — | — | — | — | — | — | — |
| 5 | 0.14 | 2.9 | 0.8 | — | — | — | — | — | — | — |
| 6 | 0.09 | 3.2 | 0.3 | — | — | — | 0.04 | — | — | — |
| 7 | 0.08 | 3.8 | 0.2 | — | — | — | — | 0.04 | — | — |
| 8 | 0.12 | 2.6 | 0.2 | — | — | — | — | — | 0.02 | 0.0017 |
| 9 | 0.07 | 3.4 | 0.1 | — | — | — | 0.02 | 0.03 | 0.025 | 0.0028 |
| 10 | 0.12 | 3.2 | 0.3 | — | — | — | — | — | — | — |
| 11 | 0.13 | 2.9 | 0.2 | — | — | — | — | — | — | — |
| 12 | 0.07 | 4.8 | 0.3 | — | — | — | — | — | — | — |
| 13 | 0.13 | 2.4 | 0.2 | — | — | — | — | — | — | — |
| 14 | 0.15 | 2.8 | 0.4 | — | — | — | — | — | — | — |
| 15 | 0.17 | 3.0 | 0.5 | — | — | — | — | — | — | — |
| 16 | 0.05 | 3.2 | 0.7 | — | — | — | — | — | — | — |
| 17 | 0.04 | 3.3 | 0.3 | — | — | — | — | — | — | — |
| 18 | 0.12 | 2.9 | 1.5 | — | — | — | — | — | — | — |
| 19 | 0.16 | 1.5 | 0.35 | 0.2 | 0.6 | 0.3 | 0.02 | — | 0.015 | 0.0015 |

Samples having a shape suitable for the test were prepared to evaluate microstructures, hardness of surface portions, impact toughness, wear resistance, and weldability of the plates thus obtained. The microstructures were observed using an optical microscope and a scanning electron microscope (SEM), and the hardness of the surface portions were measured using a Brinell hardness tester after surfaces were ground to a depth of about 2 mm. Wear resistance was tested by a method described in ASTM G65, and weight losses were measured and compared. A Y-groove test method was used for the evaluation of weldability, and preheating was not performed. Y-groove welding was performed and the presence of the occurrence of weld cracks was then observed with a microscope.

A method of preparing the samples used in the present invention was a process of obtaining marten site by hot rolling and then immediately rapid cooling. However, depending on equipment, there may be a case in which general cooling is performed after hot rolling, and martensite is obtained by rapid cooling after reheating using separate heat treatment equipment. The latter has been typically used as a method of manufacturing a wear resistant steel for abrasive wear resistance. However, recently, there may be a case in which a wear resistant steel is manufactured by the former method, i.e., direct quenching, in order to shorten delivery time and reduce manufacturing costs. The present invention is suitable for the two manufacturing methods.

TABLE 2

| Steel | Microstructure (martensite fraction) % | Packet diameter μm | Brinell hardness HB | Impact toughness (−40° C.) J | ASTM G65 abrasion test weight loss g | The presence of the occurrence of Y-groove cracks | Category |
|---|---|---|---|---|---|---|---|
| 1 | M(100) | 15 | 438 | 31 | 1.21 | No occurrence | Inventive material |
| 2 | M(95) + B(5) | 12 | 379 | 27 | 1.22 | No occurrence | Inventive material |
| 3 | M(100) | 12 | 403 | 28 | 1.25 | No occurrence | Inventive material |
| 4 | M(96) + B(4) | 17 | 370 | 39 | 1.35 | No occurrence | Inventive material |
| 5 | M(100) | 11 | 439 | 29 | 1.12 | No occurrence | Inventive material |
| 6 | M(97) + B(3) | 9 | 388 | 35 | 1.25 | No occurrence | Inventive material |
| 7 | M(100) | 17 | 398 | 28 | 1.33 | No occurrence | Inventive material |
| 8 | M(100) | 10 | 421 | 37 | 1.29 | No occurrence | Inventive material |
| 9 | M(95) + B(5) | 7 | 362 | 45 | 1.24 | No occurrence | Inventive material |
| 10 | M(75) + B(25) | 15 | 342 | 52 | 1.46 | No occurrence | Comparative material |
| 11 | M(100) | 28 | 409 | 12 | 1.23 | No occurrence | Comparative material |
| 12 | M(97) + B(3) | 12 | 398 | 35 | 1.19 | Occurrence | Comparative material |

TABLE 2-continued

| Steel | Microstructure (martensite fraction) % | Packet diameter μm | Brinell hardness HB | Impact toughness (−40° C.) J | ASTM G65 abrasion test weight loss g | The presence of the occurrence of Y-groove cracks | Category |
|---|---|---|---|---|---|---|---|
| 13 | M(70) + B(30) | 17 | 355 | 36 | 1.38 | No occurrence | Comparative material |
| 14 | M(100) | 14 | 445 | 15 | 1.16 | Occurrence | Comparative material |
| 15 | M(95) + B(5) | 15 | 465 | 8 | 1.14 | Occurrence | Comparative material |
| 16 | M(90) + B(10) | 15 | 352 | 46 | 1.28 | No occurrence | Comparative material |
| 17 | M(97) + B(3) | 12 | 358 | 51 | 1.43 | No occurrence | Comparative material |
| 18 | M(100) | 14 | 451 | 10 | 1.08 | Occurrence | Comparative material |

where M represents martensite and B represents bainite

As illustrated in Table 2, it may be understood that Steels 1 to 9, as inventive materials, had steel compositions satisfying the composition range of the present invention and their Brinell hardness values were included in a range of 360 to 440. Among them, in the case that niobium or vanadium was added (Steels 6, 7 and 9), their hardness were further increased, and particularly, in the case in which niobium is added (Steels 6 and 9), the diameter of packets was also small. As a result, relatively high impact toughness was obtained. In the case that titanium and boron were added in combination (Steels 8 and 9), high impact toughness was also obtained. In particular, with respect to Steel 9 in which niobium, vanadium, titanium, and boron were all added, the highest impact toughness was obtained.

Abrasion test results were largely depend on Brinell hardness, and, in the case that the fraction of bainite in the microstructure was high, wear resistance was significantly reduced.

Since compositions or microstructures of Steels 10 to 18, as comparative materials, were not included in the ranges of the present invention, performances, such as Brinell hardness, impact toughness, and weldability, were degraded.

Steel 10 is a case in which the composition thereof satisfied the range of the present invention, but a cooling rate after rolling was low, wherein the fraction of martensite in the final microstructure was low at 75%, and the rest was bainite. In this case, Brinell hardness was lower than the range limited in the present invention, and in particular, wear resistance was significantly reduced.

With respect to Steel 11, the microstructure thereof was composed of 100% martensite. However, since the diameter of packets was large at 28 μm, impact toughness was low.

With respect to Steel 12, as a case in which manganese was added in an amount greater than the range limited in the present invention, good hardness and impact toughness were obtained. However, cracks occurred during the Y-groove test.

In contrast, Steel 13 was a case in which manganese was added in an amount less than the range limited in the present invention. Since hardenability was low, about 30% of bainite was formed even in the case in which accelerated cooling was performed with high-pressure water. Thus, the hardness of a surface portion was lower than the range of the present invention, and as a result, wear resistance was also significantly reduced.

Steels 14 and 15 were cases in which the amount of carbon was greater than the range limited in the present invention, wherein hardness values were greater than the range of the present invention and particularly, cracks occurred during the Y-groove test while exhibiting low impact toughness.

Steel 16 was a case in which the amount of carbon was less than the limited range of the present invention, wherein since the fraction of martensite was low at 90%, hardness was low.

Steel 17 was also a case in which the amount of carbon was less than the limited range of the present invention, wherein the fraction of martensite was included in the range limited in the present invention. However, since the amount of carbon was low, hardness was low.

With respect to Steel 18, since silicon was added in an amount greater than the limited range of the present invention, the hardness of a surface portion obtained was a high value that is outside the range of the present invention, and cracks occurred during the Y-groove test.

To date, nickel, molybdenum, and chromium have been frequently used to obtain a microstructure that is required for a wear resistant steel for abrasive wear resistance. However, in the present invention, manganese, which was inexpensive while exhibiting performance similar to the above alloying elements, was selected in order to reduce manufacturing costs.

Figure 4:
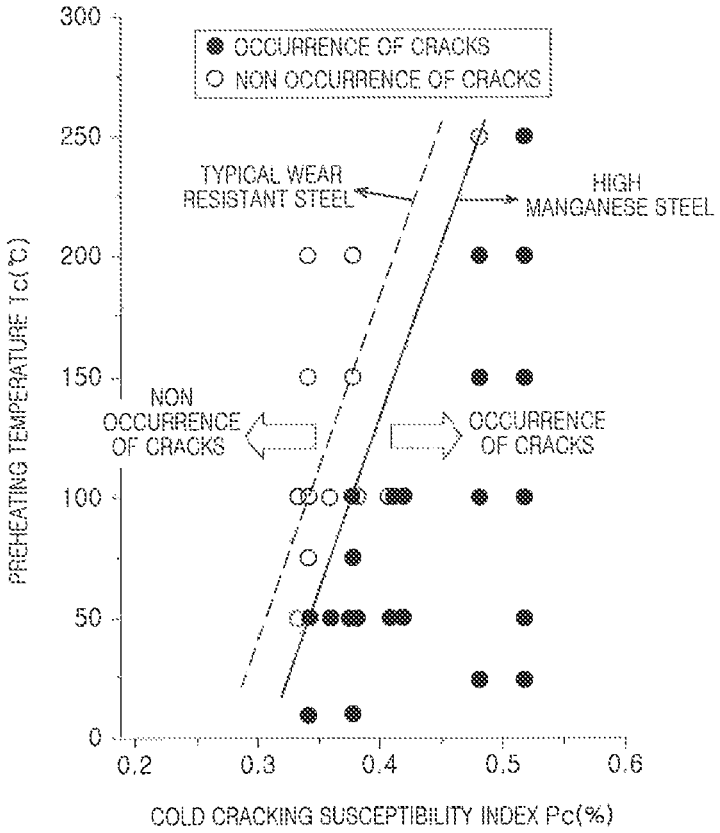
FIG. 4 illustrates weldability of a high manganese wear resistant steel according to the present invention and a typical wear resistant steel according to a $P_c$ value.

Also, illustrated in FIG. 4, since manganese simultaneously had an excellent effect of improving the weldability of a wear resistant steel, manganese was selected as the most important hardening element in the present invention.

FIG. 4 is a graph comparing weldabilities of a typical wear resistant steel and a high manganese wear resistant steel devised in the present invention. The typical wear resistant steel denotes a wear resistant steel that is currently available, and the high manganese wear resistant steel denotes a wear resistant steel that satisfies the composition range and the manufacturing method according to the present invention. Y-groove tests were performed by using various kinds of alloy compositions and product thicknesses to observe the presence of the occurrence of weld cracks. Also, in order to evaluate the effect of preheating during welding, preheating was performed in a wide range and test was then performed.

A $P_c$ value, as the axis of abscissa in FIG. 4, is determined by an alloy composition, the amount of hydrogen in a welding rod, and a thickness of a plate, and the $P_c$ value is expressed by the following equation.

$$P_c = P_{CM} + H/60 + t/600$$

where $P_{CM}$ is a value represented by an alloy composition and is expressed by the following equation, H is a diffusible hydrogen amount (ml/100 g) measured by a glycerin method, and t is a thickness of a plate.

$$P_{CM}(\%)=C+Si/30(Mn+Cu+Cr)/20+Ni/60+Mo/15+V/10+5B$$

Experimental results indicated as a solid line and represented as data in FIG. 4 corresponded to the high manganese wear resistant steel of the present invention, and Y-groove experimental results of the typical wear resistant steel were indicated as dotted line. FIG. 4 clearly indicates that with respect to the high manganese steel according to the present invention, a region with no occurrence of cracks moved to the right in comparison to the typical wear resistant steel. This means that the occurrence of cracks during the Y-groove test in the high manganese steel is more difficult than the typical wear resistant steel for the same $P_c$ value.

Figure 5:
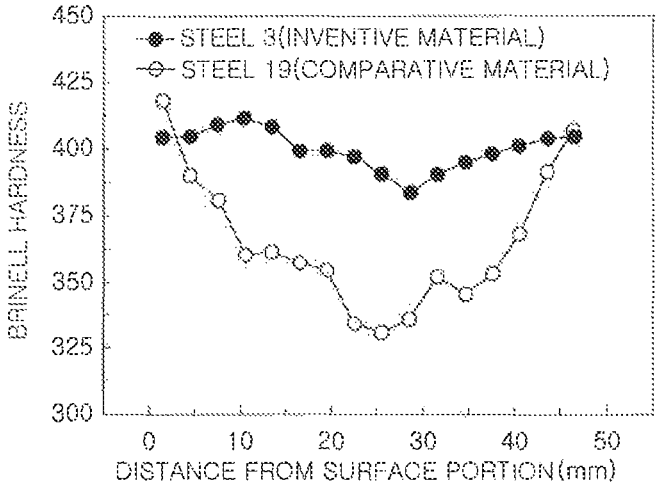
FIG. 5 illustrates changes in Brinell hardness in a thickness direction of a high manganese wear resistant steel according to the present invention and a typical wear resistant steel.

Also, FIG. 5 illustrates the results of measuring hardness distribution in a thickness direction of a wear resistant steel (Steel 3) manufactured with the component system according to the present invention and a wear resistant steel (Steel 19) manufactured by a typical technique. In this case, a thickness of both products was set as 50 mm.

As illustrated in FIG. 5, it may be confirmed that the wear resistant steel according to the present invention had constant hardness distribution in the thickness direction. In contrast, with respect to the comparative material manufactured by the typical technique, it may be confirmed that hardness was significantly reduced at the center. When the hardness was reduced as approaching to the center, the overall service life of the wear resistant steel may be reduced.

While the present invention has been shown and described in connection with the exemplary embodiments, it will be apparent to those skilled in the art that modifications and variations can be made without departing from the spirit and scope of the invention as defined by the appended claims.

The invention claimed is:

1. A wear resistant steel comprising:

2.6 wt % to 4.5 wt % of manganese (Mn);

carbon (C) satisfying $(6-Mn)/50 \leq C \leq (10-Mn)/50$;

0.05 wt % to 1.0 wt % of silicon (Si); and iron (Fe) as well as other unavoidable impurities as a remainder, wherein a microstructure of the wear resistant steel comprises martensite in an amount of 90% or more (including 100%) and bainite in an amount of 10% or less (including 0%), wherein the microstructure excludes ferrite, and wherein a Brinell hardness of a surface portion is in a range of 360 to 440.

2. The wear resistant steel of claim 1, further comprising at least one component selected from the group consisting of 0.1 wt % or less (excluding 0 wt %) of niobium (Nb), 0.1 wt % or less (excluding 0 wt %) of vanadium (V), 0.1 wt % or less (excluding 0 wt %) of titanium (Ti), and 0.02 wt % or less (excluding 0 wt %) of boron (B).

3. The wear resistant steel of claim 1, wherein an average packet diameter of the martensite is 20 μm or less.

4. The wear resistant steel of claim 1, wherein the microstructure consists of the marteniste and the bainite in a total amount of 100%.

* * * * *